United States Patent [19]

Hella

[11] Patent Number: 4,922,628

[45] Date of Patent: May 8, 1990

[54] WEB DRYERS OR THE LIKE HAVING AIRFOIL MEANS FOR CONTROLLING A RUNNING WEB AT THE DRYER EXIT

[75] Inventor: Terry A. Hella, DePere, Wis.

[73] Assignee: Advance Systems, Inc., Green Bay, Wis.

[21] Appl. No.: 341,911

[22] Filed: Apr. 24, 1989

[51] Int. Cl.[5] ..... F26B 13/00

[52] U.S. Cl. ..... 34/156; 226/97; 68/5 E

[58] Field of Search ..... 34/23, 156, 242, 160; 226/97; 68/5 D, 5 E

[56] References Cited

U.S. PATENT DOCUMENTS

| | | | |
|---|---|---|---|
| 3,662,476 | 5/1972 | Capizzi | 34/160 X |
| 3,763,571 | 10/1973 | Vits | 34/156 X |
| 4,462,169 | 7/1984 | Daane . | |
| 4,693,014 | 9/1987 | Caflisch et al. | 34/23 |
| 4,785,986 | 11/1988 | Daane et al. . | |
| 4,833,794 | 5/1989 | Stibbe et al. | 34/160 |
| 4,837,946 | 6/1989 | Hella et al. . | |

*Primary Examiner*—Henry A. Bennet
*Assistant Examiner*—John Sollecito
*Attorney, Agent, or Firm*—Nilles & Nilles

[57] ABSTRACT

A web dryer for floatingly suspending a running web and having a horizontal exit slot through which the web exits from the dryer, makeup air being drawn into the dryer through said slot and in a direction opposite to that of web exit movement. The running web is forced to move up or down based on the fluctuations in air movement and which cause the web to billow across its width, a rotatable roll arranged is in parallelism to the exit slot and located downstream from the web exit slot and around which roll the moving web is wrapped. The web, due to said tendency to billow across its width, thereby creates a tight side of the web around the roll and consequently transversely shifts to the tight side. An airfoil is located transversely across the web and adjacent and inside of the horizontal web exit slot, whereby the incoming makeup air is uniformly distributed transversely by the airfoil and across the web width to eliminate uncontrolled web billowing and consequent transverse shifting of the web. The airfoil has an outwardly inclined, trailing edge in respect to the direction of movement of the incoming makeup air in a direction opposite to that in which the moving web approaches the airfoil, whereby said airfoil presents an area of negative pressure for the web passing thereover.

10 Claims, 3 Drawing Sheets

WEB DRYERS OR THE LIKE HAVING AIRFOIL MEANS FOR CONTROLLING A RUNNING WEB AT THE DRYER EXIT

BACKGROUND OF THE INVENTION

Running web dryers and/or smoke tunnels have exits for web which are formed by a generally horizontal slot. As the web passes through this exit slot, makeup air is drawn into the dryer in a direction opposite to that of the web movement. As a result the web is forced to move up or down based on the fluctuations in the air movement and the volumes of air. This up and down movement of the web is unequal across its width and is referred to as billowing. As the web billows from side-to-side it contacts the downstream roll at one side or the other which causes a tight side of the web and consequent movement of the web to that tight side of the roll. This side-to-side movement is normally attempted to be corrected by means of a web aligner downstream and due to tolerances in the web aligner, some of the movement carries through to the end of the process. The side-to-side web movement may exceed the limits of the web aligners to correct the side-to-side movement.

One example of a web dryer and smoke tunnel with which the present invention finds particular utility is shown in the U.S. Pat. No. 4,462,169 issued July 31, 1984 to Daane. The smoke tunnel designs shown in FIGS. 1 and 2 of that patent are of the type which are intended to be improved upon by the present airfoil. In that patent, as air is drawn back into the smoke tunnel through the sharp edge split orifice 40 in FIG. 1, the air is allowed to expand abruptly within the smoke tunnel and that causes uncontrolled billowing of the web. The arrangement of FIG. 2 of that patent has a different arrangement of the chill rolls when the exit end of the smoke tunnel discharges between the two vertically aligned, adjacent chill rolls.

The airfoils of the present invention can also be used within the dryer housing itself and at the exit end, for instance where a smoke tunnel is not used, but where the web is subsequently engaged downstream by a chill roll, for example. Such housings are shown in U.S. Pat. No. 4,785,986 issued Nov. 22, 1988 to Hella or in the co-pending application Ser. No. 341,816 filed Apr. 24, 1989 by Hella and Perry, or in U.S. application Ser. No. 165,746 filed Mar. 9, 1988 by Hella and Stibbe and which issued as U.S. Pat. No. 4,837,946 on June 13, 1989, all of which have been assigned to an assignee common with this application.

SUMMARY OF THE INVENTION

The present invention provides a web dryer or the like which has an airfoil just inside the web exit slot of the dryer, which foil controls the incoming (makeup) air and causes the incoming air to be uniformly distributed transversely across the web width. This controls the web in proximity to the airfoil surface and is intended to eliminate the uncontrolled "across machine" web billowing. The airfoil holds the web in a given relationship to its surfaces, based upon the inclined foil design and the air flow across its face.

The present invention provides airfoils in the exit end of a web dryer or the like for controlling the forces exerted on the running web by the air moving over it. As a result, the web is controlled to a given configuration and held stable. In other words, the airfoil provided by the present invention eliminates the uncontrolled "across machine" billowing of the web, due to uncontrolled air movement, and the side-to-side movement of the web can be controlled or eliminated.

A more specific aspect of the invention relates to airfoils of the above type and which have inclined entry and exit edges and aperture construction which result in effective and efficient handling of the running web.

These and other objects and advantages of the present invention will appear hereinafter as this disclosure progresses.

DESCRIPTION OF A PREFERRED EMBODIMENT

Figure 1:
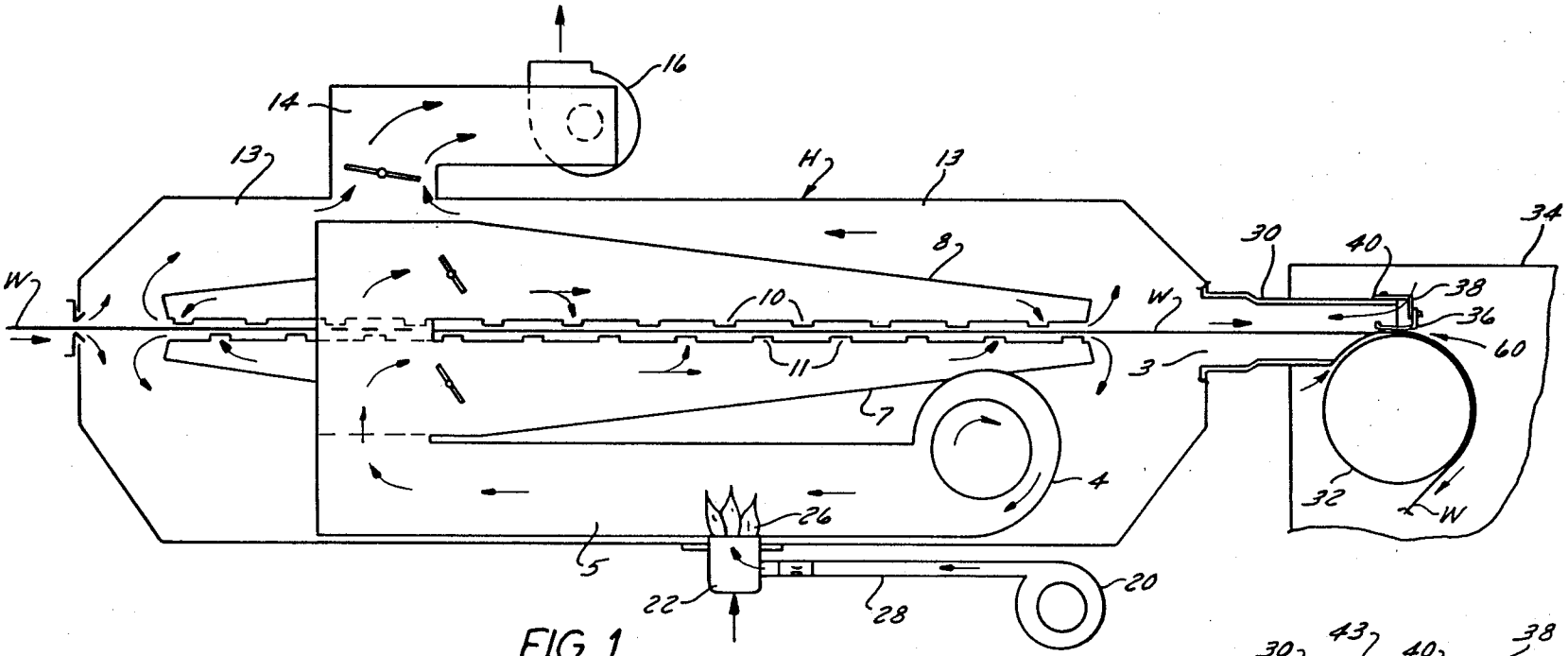
FIG. 1 is a generally schematic, longitudinal cross-sectional view through a web dryer and having a smoke tunnel at its exit end and from which the web exits and then wraps around a chill roll.
Figure 2:
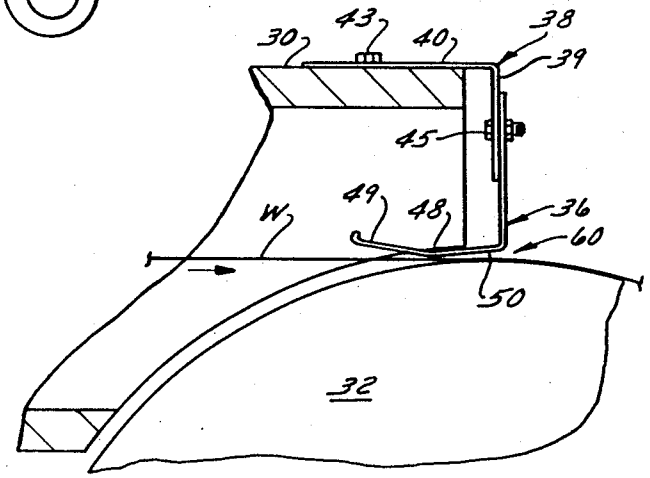
FIG. 2 is a fragmentary enlarged view of the exit end of the smoke tunnel and chill roll.

FIGS. 1 and 2

The present invention finds utility with a web dryer and smoke tunnel, such as shown here schematically in FIG. 1, and in which a web W is floatingly suspended without contact as it passes through the dryer. The dryer D includes an enclosed housing H which is of conventional character, is insulated and has access doors (not shown), and a horizontal inlet slot 2 is provided at the web inlet end of the dryer and through which the web enters the dryer. At the other end of the dryer housing is a horizontal exit slot 3 for the web. The web passes through the dryer at many hundreds of feet per minute and exits from the dryer in a dry condition. In installations of this type the web many be printed on each side and is floatingly suspended as it passes through the dryer without contacting any of the parts of the dryer.

Within the dryer housing is an air supply fan 4 which is suitably driven by a motor (not shown) and delivers high velocity air to the air supply duct 5 which in turn is in air delivering communication with the lower air supply duct means and the upper air supply duct means 8. The air from the air supply duct means 7 and 8 is then delivered to the series of transversely positioned upper air bars 10 and lower air bars 11 which are located, respectively, on the upper and lower sides of the running web W. The upper air bars 10 are longitudinally staggered in relationship to the lower air bars 11 so that the web passes in a sine wave form of conventional character through the dryer. The spent air, after it passes through the air bars to perform its drying function, flows into the general interior 13 of the enclosed housing H and is exhausted therefrom via the exhaust duct 14 with the aid of the exhaust fan 16. The above arrangement is conventional and is shown, in various forms, in the above mentioned patents.

Means are provided for furnishing hot air to the air supply duct 5 for the purpose of furnishing heat for drying the running web. This means includes a combustion blower 20 for furnishing air to a gas burner 22 and gas is supplied from a conventional source (not shown) through the pipe 24 to the burner 22 where it is mixed with air from blower 20 and results in the heated air being delivered via the burner outlet 26 attached in communication with the duct 5 to the interior of the air supply duct 5 located within the housing H. The supply air is delivered from the combustion blower 20 via the pipe 28 to the burner 22.

Figure 6:
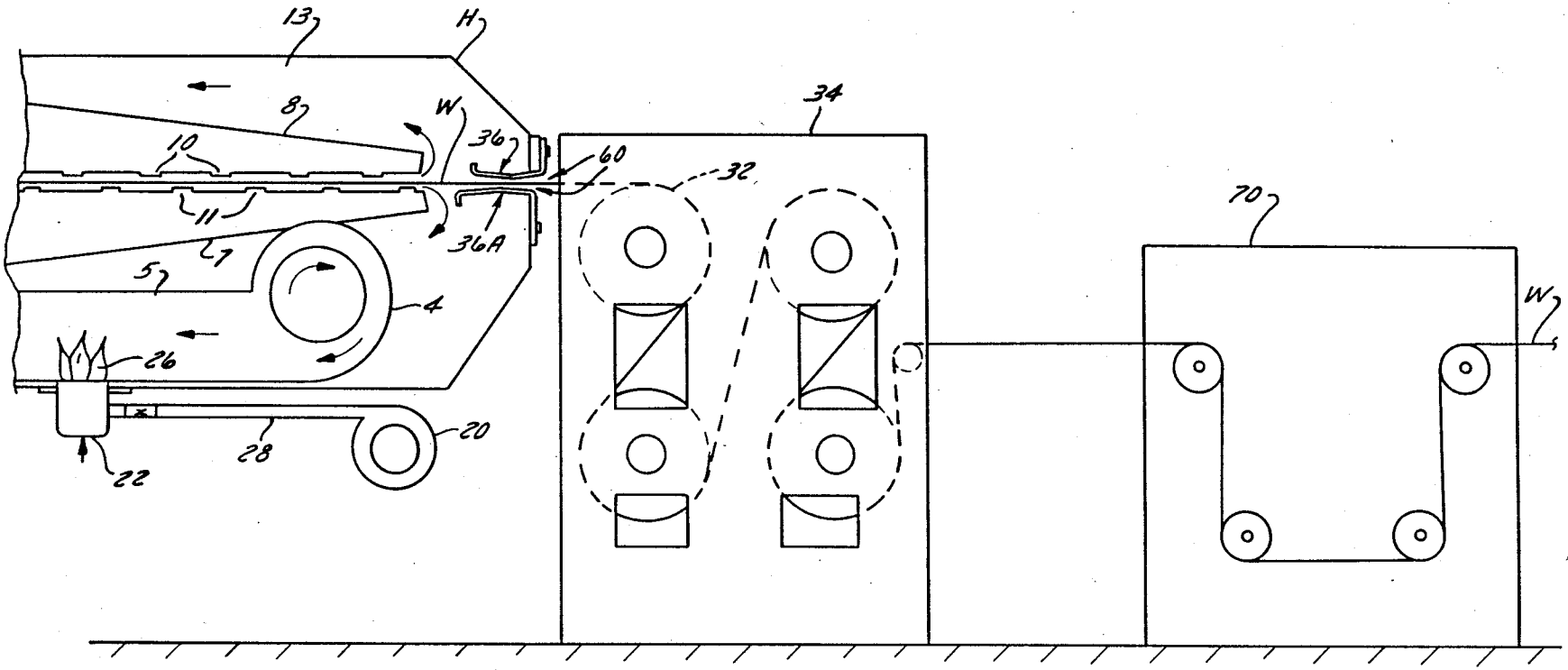
FIG. 6 is another modification of the invention showing the discharge end of the web dryer having opposed airfoils at its discharge end and through which the web passes directly to the chill rolls and then to a web aligner.

As the web leaves the exit slot in the dryer it enters the enclosed smoke tunnel 30, the exit end of the smoke tunnel being located in proximity to the first chill roll 32 of the series of chill rolls which are rotatably mounted in parallelism on the chill stand 34; such is shown in FIG. 6. Such an arrangement is shown in the U.S. Pat. No. 4,462,164 issued July 31, 1984 to Daane.

At the discharge end of the smoke tunnel 30 (FIG. 1), there is provided a single, upper airfoil 36 (which is also shown in FIGS. 3–6) which is adjustably mounted on the end of the smoke tunnel 30 by means of the airfoil mounting plate 38 which is fabricated from sheet metal and is formed in a right angular configuration. Plate 38 has a vertical flange 39 and a horizontal flange 40. The vertical flange 39 has a series of transversely spaced holes 41 (FIG. 5) and the upper horizontal flange 40 has a series of transversely spaced slots 42. Bolt means 43 (FIG. 2) extend through slots 42 and through the upper portion of the smoke tunnel 30 and are threadably engaged so as to be adjustably and fixably mounted on the end of the smoke tunnel. By this means the airfoil can be adjusted longitudinally in respect to the chill roll and smoke tunnels.

The airfoil 36 (FIGS. 2 and 5) has a vertical flange portion 43 which also has a series of transversely spaced, elongated slots 44. Bolt means 45 extend through the apertures in flange 39 of the mounting plate and through the slots 44 of the airfoil 36 to thereby provide adjustability of the airfoil in a vertical direction and in respect to the web to thereby closely regulate its proximity to the web. Such an adjustment compensates for manufacturing tolerences and permits the airfoils to be positioned straight and parallel to the web path.

Figure 3:
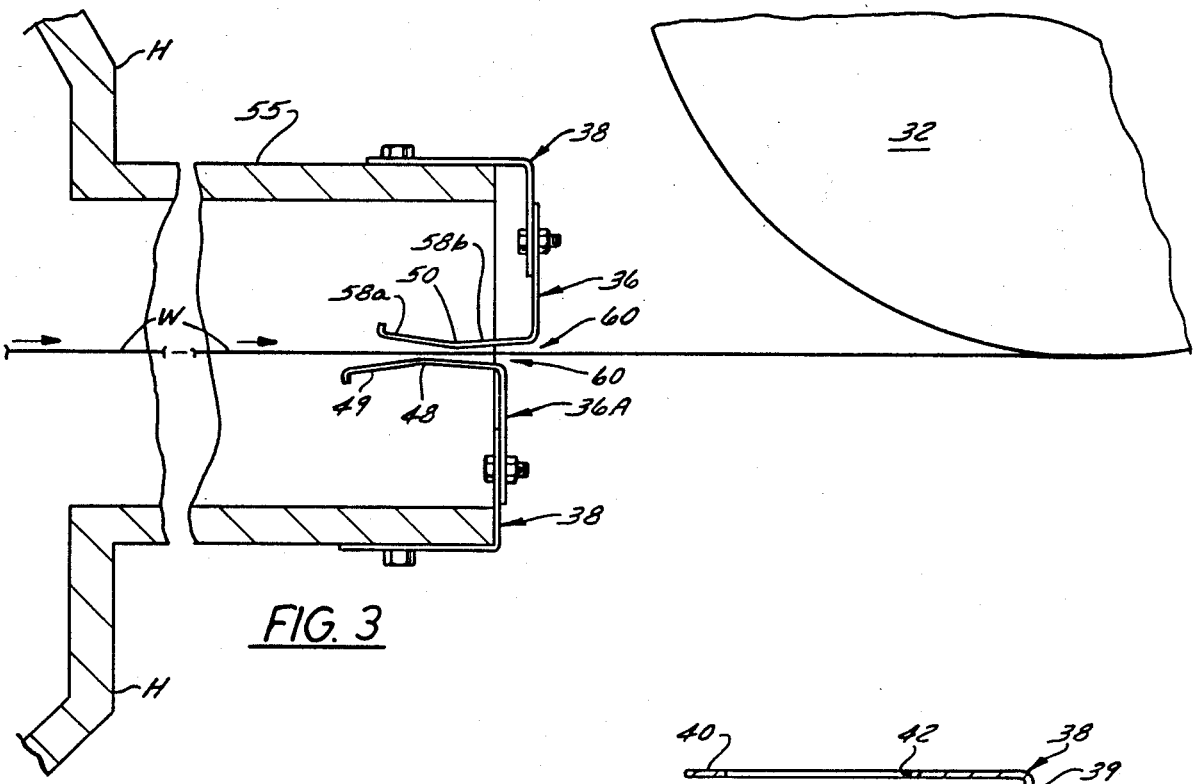
FIG. 3 is a fragmentary, longitudinal cross-sectional view through another form of smoke tunnel at the end of the dryer housing, and showing upper and lower airfoils through which the web passes to then be engaged by the chill roll.
Figure 5:
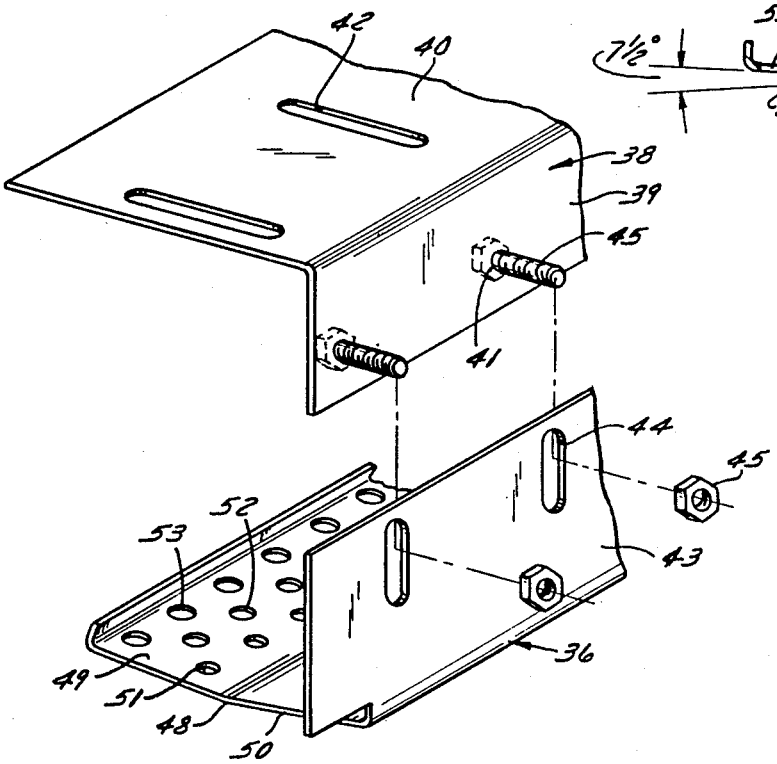
FIG. 5 is a fragmentary, perspective, exploded view of a portion of the airfoil and its mounting plate.

Similar airfoils 36 are provided for the arrangements shown in FIGS. 3 and 6. In regard to the structure of the airfoils, they have a generally horizontal portion 48 which is comprised of an inclined trailing edge 49 (in respect to the direction of makeup air movement) and an inlet edge 50 which is also inclined and it is designated as the inlet edge because it is located at the inlet of the makeup air coming into the smoke tunnel as shown by numerals 60 in FIG. 3. The angle of inclination of the trailing edge 49 with respect to the theoretical web line W is about 7.5°. The angle of inclination of the inlet edge 50 with respect to the theoretical web line is about 3° . The area between the web and the trailing edge 59 is an area of negative pressure where the air expands and slows down just as it enters into the enlarged chamber of the smoke tunnel It will also be noted, as will momentarily appear, that the trailing edge is perforated (FIG. 5). The area between the inlet edge 50 of the airfoil and the web is an area of pressure build-up as the makeup air rushes into the chamber. If the airfoil edge 50 at inlet were parallel to the web, there would be considerable turbulence. By making the entry edge inclined, it helps increase the orifice coeficient and permits more or less gradual entry of the air into the smoke chamber As to the trailing edges 49 of the airfoils within the chamber, if they were formed parallel to the theoretical web line, that is if they came straight into the chamber, then there would be an abrupt end at the end of the airfoil, which would also create turbulence. With the trailing edge at an angle, and furthermore perforated, this construction allows breathing of the area across the surface of the trailing edge and promotes stability of the web, that is, it acts as an air pressure release and permits the air to expand and slow down.

As mentioned above, the inclined trailing portion 49 of the airfoil has three transversely arranged rows of holes 51, 52 and 53, holes 53 being the largest in diameter as clearly shown in FIG. 5. These holes act to relieve the air pressure between the airfoil and the incoming web. The inner rows of holes 53 are largest to provide progressive air relief.

Figure 4:
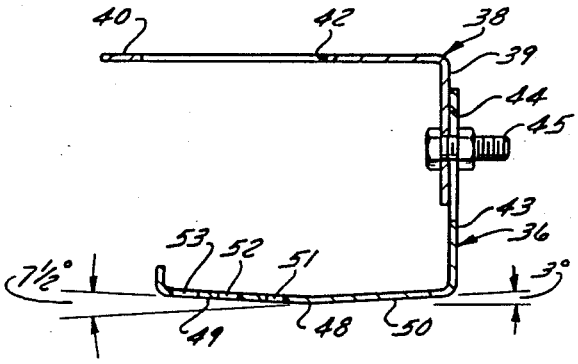
FIG. 4 is a cross-sectional view through the upper airfoil and its mounting plate, as shown in FIG. 3, but the view being in section and slightly enlarged from that shown in FIG. 3.

FIGS. 3 through 5

An alternative smoke tunnel and chill roll arrangement is shown in FIG. 3, in which the smoke tunnel 55 is provided with an upper airfoil 36 and a similar lower airfoil, 36A which are located just inside the exit end of the smoke tunnel 55, the web W passing between the airfoils 36 and 36A which define the horizontal exit slot.

FIG. 6

Still another alternative is shown in FIG. 6 where a pair of similar airfoils 36, 36A which are used at and within the discharge end of the dryer housing itself. After leaving the dryer exit slot formed by the airfoils, the web directly engages chill roll 32 of the chill roll stand 34 or the like downstream of the dryer and without going through a smoke tunnel. The web then runs through a conventional web aligner 70.

Operation and Recapitulation

In any of the embodiments, as the running web leaves the exit slot, whether that slot is in the dryer itself or at the end of the smoke tunnel, it contacts a subsequent roll, such as a chill roll. Without the airfoils provided by the present invention, the incoming air, which moves in a direction opposite to that of the web and which air is referred to as "makeup air", causes the web to be drawn up or down based upon the fluctuations in air movement and the air volume. This movement of the web in an up and down direction, and unequally across its width, also creates a web movement from side to side from its normal longitudinal path.

It will also be noted that when both an upper and a lower airfoil are used on opposite sides of the web, as shown for example in FIGS. 3 and 6, the airfoils do not terminate at the same longitudinal position but instead their downstream ends are staggered This creates an intentional imbalance and prevents one of the airfoils from "fighting"the other one. Stated otherwise, if both the upper and lower airfoils were in vertical alignment, instability would be created when the air pressure and air release points would be in direct vertical alignment. If the airfoils are off-set longitudinally from one another, the forces compliment each other.

By means of the airfoils, it is possible to control the air forces exerted on the web by the air moving over the web, and the web can be controlled to a given configuration and be held stable. This means eliminates the uncontrolled "across machine" billowing of the web due to otherwise uncontrolled air movement. Consequently this side-to-side movement in a transverse direction of the web can be controlled or eliminated.

The chill roll or other roll located downstream of the web exit without the use of the present airfoils, and due to the web billowing, would cause the web to contact the roll and thus create a tight side of the web at that contact side. This in turn causes the web to climb or shift transversely towards the tight side. In other words, as the web would billow from one side or the other prior to contacting the subsequent roll, it would create a tight side and thus cause the web to move to that side.

The present particularly shaped and constructed airfoils, by controlling the incoming air uniformly across the web width, and controlling the web in proximity to the airfoil surface, eliminate this uncontrolled "across web" billowing.

I claim:

1. A web dryer or the like having air bars spaced along its interior length, for floatingly suspending a running web without contact as it moves through the dryer, said dryer having a horizontal exit slot through which the web exits from the dryer, makeup air being drawn into the dryer through said slot and in a direction opposite to that of web exit movement, the arrangement being such that the running web is forced to move up or down based on the fluctuations in air movement and which cause the web to billow across its width, a rotatable roll means arranged in parallelism to said exit slot and located downstream from the web exit slot and around which roll means the moving web is wrapped, the construction and arrangement causes said web due to said tendency to billow across its width to create a tight side of the web around the roll means and consequently transversely shifts to that tight side, and an airfoil located transversely across the web and adjacent and inside of the horizontal web exit slot, whereby the incoming makeup air is uniformly distributed transversely by the airfoil and across the web width to eliminate uncontrolled web billowing and consequent transverse shifting of the web.

2. The web dryer set forth in claim 1 further characterized in that said airfoil has an edge which is inclined away from said web, said edge located in a trailing position in respect to the direction of movement of the incoming makeup air and in a direction opposite to that in which said moving web approaches said airfoil, said airfoil presenting an area of negative pressure for the web passing thereover.

3. The dryer set forth in claim 2 wherein the said inclined edge is at an angle of about seven and one-half degrees with respect to the path of the running web.

4. The web dryer set forth in claim 2 further characterized in that said airfoil has inclined, an edge which is inclined away from said web, said edge located in a trailing position in respect to direction of movement of the upcoming makeup air, and said airfoil presenting an area of positive pressure for the web passing thereover.

5. The dryer set forth in claim 4 wherein the said inclined inlet edge is at an angle of above three degrees with respect to the path of the running web.

6. The web dryer set forth in claim 1 wherein said airfoil includes an airfoil on each side of said web.

7. The web dryer set forth in claim 6 further characterized in that said airfoils are longitudinally staggered in respect to the direction of web travel and in respect to one another, whereby the pressure point and the release point of the airfoil are not in longitudinal alignment, to thereby create an air imbalance and prevent the incoming air on one side of the web from acting in opposition to the incoming air on the opposite side of said web.

8. The web dryer set forth in claim 2 in which said trailing edge of said airfoil has a series of apertures therein and extending transversely therealong for relieving air pressure on the web at said trailing edge and permitting the incoming air to expand and slow down.

9. The web dryer set forth in claim 1 wherein said airfoil has an attaching flange extending in a direction away from said web, said flanges having a series of elongated adjusting slots therein, and means extending through said slots and through said dryer whereby said airfoil can be selectively spaced apart from said web and locked in said adjusted position.

10. The web dryer set forth in claim 2 wherein said airfoil has an attaching flange extending in a direction away from said web, said flanges having a series of elongated adjusting slots therein, and means extending through said slots and through said dryer whereby said airfoil can be selectively spaced apart from said web and locked in said adjusted postion.

* * * * *